US005653640A

United States Patent [19]

Shirley, Jr.

[11] Patent Number: 5,653,640

[45] Date of Patent: Aug. 5, 1997

[54] ILLUMINATED POOL GAME APPARATUS

[76] Inventor: Roy J. Shirley, Jr., 10 Glenview La. P.O. Box 774, Uwchland, Pa. 19480

[21] Appl. No.: 642,930

[22] Filed: May 6, 1996

[51] Int. Cl.[6] ..... A63D 15/00

[52] U.S. Cl. ..... 473/2

[58] Field of Search ..... 273/DIG. 24, 58 R, 273/586; 473/354, 2

[56] References Cited

U.S. PATENT DOCUMENTS

| | | | |
|---|---|---|---|
| 3,458,205 | 7/1969 | Smith | 473/353 |
| 3,743,288 | 7/1973 | Danklefsen | 473/2 |
| 3,782,730 | 1/1974 | Horchler | 473/353 |
| 3,804,411 | 4/1974 | Hendry | 273/DIG. 24 |
| 3,917,264 | 11/1975 | Davidson | 473/52 |
| 3,917,560 | 11/1975 | Panosh | 273/DIG. 24 |
| 4,688,796 | 8/1987 | Wright | 473/2 |
| 4,695,055 | 9/1987 | Newcomb | 273/DIG. 24 |
| 5,080,359 | 1/1992 | Thill | 273/DIG. 24 |
| 5,301,955 | 4/1994 | Fedullo | 273/DIG. 24 |
| 5,388,825 | 2/1995 | Myers | 273/58 G |

FOREIGN PATENT DOCUMENTS

| | | | |
|---|---|---|---|
| 731004 | 8/1932 | France | 473/2 |
| 2232606 | 12/1990 | United Kingdom | 473/2 |

*Primary Examiner*—Theatrice Brown

[57] ABSTRACT

An illuminated pool game including balls each with a spherical shell and hollow spherical interior space. Also included is a plurality of optic fibers having an associated light located within the interior space of each ball. Each optic fiber includes a first end in communication with the interior space of the ball and a second end in communication with an outer surface of the ball for emitting light therefrom. Also included is a pool table comprising a multiplicity of light units each secured within an associated bore formed below a playing surface thereof. Such light units include both motion detection and timer circuitry for simulating an illuminated trail when a ball is rolled thereon. The table further includes a transparent peripheral bumper including a plurality of bulbs for the illumination thereof. A ball return cut out is formed on a side portion of the pool table. The ball return cut out comprises an optic fiber situated along a periphery thereof for illuminating the same. Finally, an elongated pool cue with a tip end and a handle end is included. The pool cue comprises an optic fiber longitudinally situated therein with an associated light for emitting light from the tip end of the cue via the optic fiber.

5 Claims, 3 Drawing Sheets

FIG 1
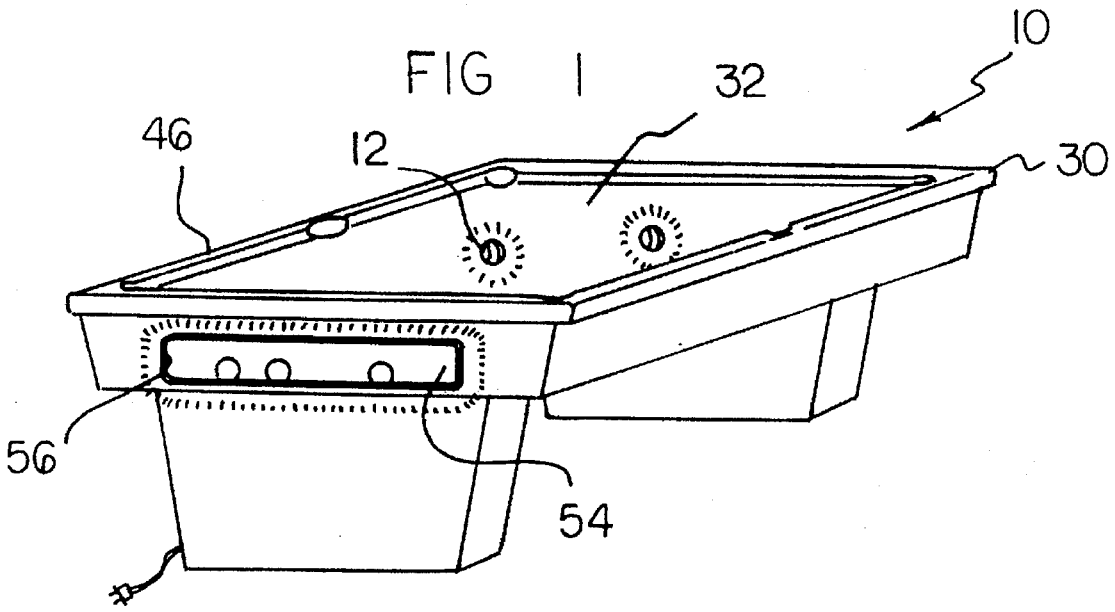
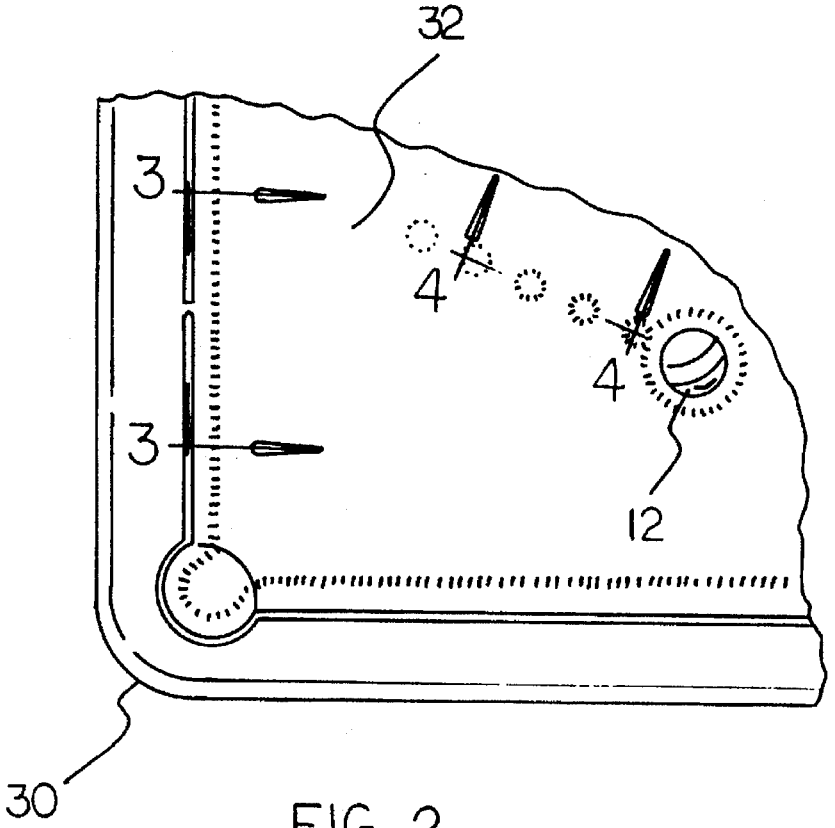
FIG 2

FIG 3
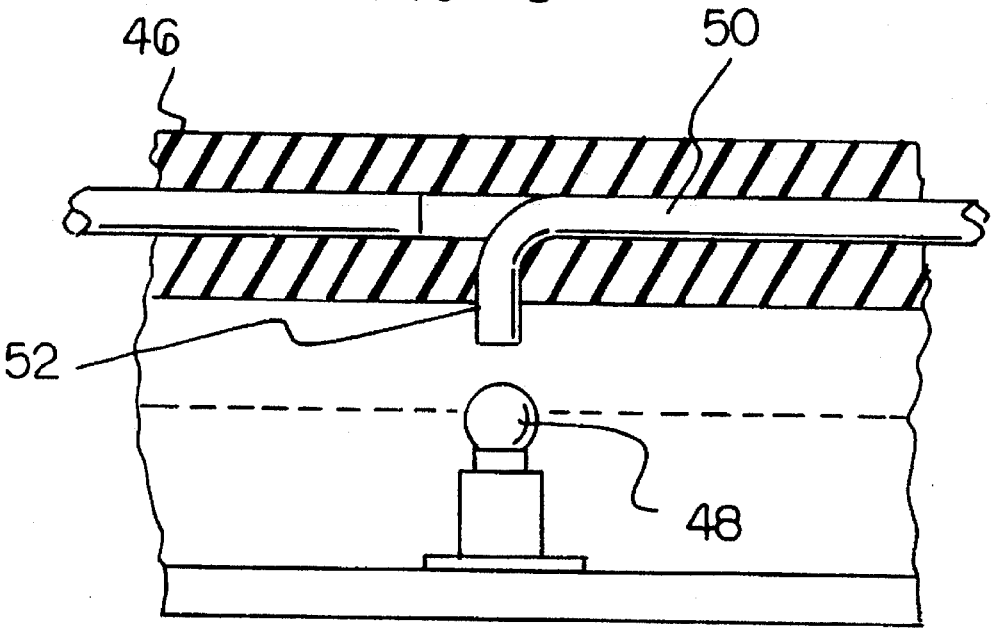
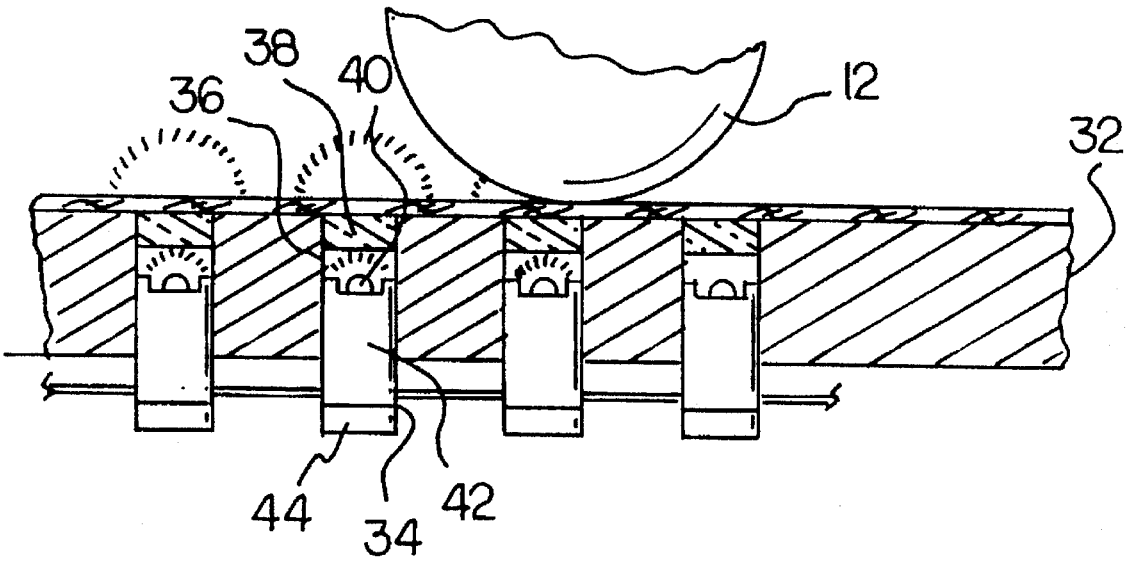
FIG 4

ILLUMINATED POOL GAME APPARATUS

BACKGROUND OF THE INVENTION

1. Field of the Invention

The present invention relates to an illuminated pool game and more particularly pertains to playing pool in the absence of ambient light and improving the aesthetic appearance thereof.

2. Description of the Prior Art

The use of pool tables is known in the prior art. More specifically, pool tables heretofore devised and utilized for the purpose of playing pool are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 3,889,945 to Ellis; U.S. Pat. No. 4,029,313 to Angulo; U.S. Pat. No. Des. 257,469 to Moore; U.S. Pat. No. 5,275,398 to Compton; U.S. Pat. No. 5,290,030 to Medbury; and U.S. Pat. No. 5,026,053 Paterson et al. devices which are all of general interest.

In this respect, the illuminated pool game according to the present invention substantially departs from the conventional concepts and designs of the prior art, and in so doing provides an apparatus primarily developed for the purpose of playing pool in the absence of ambient light and improving the aesthetic appearance thereof.

Therefore, it can be appreciated that there exists a continuing need for a new and improved illuminated pool game which can be used for playing pool in the absence of ambient light and improving the aesthetic appearance thereof. In this regard, the present invention substantially fulfills this need.

SUMMARY OF THE INVENTION

In view of the foregoing disadvantages inherent in the known types of pool tables now present in the prior art, the present invention provides an improved illuminated pool game. As such, the general purpose of the present invention, which will be described subsequently in greater detail, is to provide a new and improved illuminated pool game which has all the advantages of the prior art and none of the disadvantages.

To attain this, the present invention essentially comprises a plurality of balls each comprising a spherical shell with a hollow spherical interior. The shell includes a first half and a second half both equivalently sized and screwably coupled. A plurality of optic fibers are included with a first end in communication with an outer surface of the shell and a second end in communication with an inner surface of the shell. Thus, the fibers are adapted to emit light from the outer surface of the shell upon the application of light to the second end thereof. Each ball further comprises a tripod brace having a first leg coupled to the inner surface of the first half of the shell. A pair of remaining legs is adapted to abut the inner surface of the second half when the halves are screwably fixed. A light emitting diode is coupled to an apex of the brace. For powering purposes, a battery is electrically coupled to the light emitting diode for allowing the light emitting diode to apply light to the second end of each optic fiber. For allowing the identification of each ball, indicia in the form of a numeral is printed thereon. Also included is a pool table comprising a flat playing surface. Such surface has a multiplicity of light units each secured within an associated bore formed below a top plane thereof. Each light unit includes a transparent lens situated in a top portion of the associated bore and flush with the top plane of the playing surface. A light is adjacently situated below the lens and adapted to emit light upon the activation thereof. A motion sensor is adjacently situated below the lens for generating a detection signal upon the detection of motion directly above on the playing surface. Timer circuitry is electrically connected to the light emitting diode, motion sensor, and a power bus situated beneath the playing surface. The timer circuitry activates the associated light for a predetermined amount of time upon the receipt of the detection signal. A transparent layer covers the entire playing surface whereby when a ball is rolled thereon, the lights temporarily emit light thus simulating an illuminated trail. The table further includes a transparent peripheral bumper including a plurality of bulbs. Such bulbs are fixed within associated compartments formed in the bumper. A plurality of optic fibers are horizontally situated within the bumper adjacent to an inner edge thereof. Each optic fiber has an end normally situated with respect to the remaining fiber and further positioned adjacent to the bulb for illuminating the entire bumper. A ball return cut out is formed on a side portion of the pool table. The ball return cut out comprises an optic fiber situated along a periphery thereof for illuminating the same. With reference now to FIG. 5, an elongated pool cue with a tip end and a handle end is included. The pool cue comprises an optic fiber longitudinally situated within an axial bore formed therein. The fiber has a first end situated adjacent to the tip end of the cue, a transparent tip constructed of a resilient material secured to the tip end thereof, and a light electrically connected to a plurality of batteries situated within the handle end of the cue. Thus, the light is adapted to emit light from the tip end of the cue via the optic fiber.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved illuminated pool game which has all the advantages of the prior art pool tables and none of the disadvantages.

It is another object of the present invention to provide a new and improved illuminated pool game which may be easily and efficiently manufactured and marketed.

It is a further object of the present invention to provide a new and improved illuminated pool game which is of a durable and reliable construction.

An even further object of the present invention is to provide a new and improved illuminated pool game which is susceptible of a low cost of manufacture with regard to both materials and labor, and which accordingly is then susceptible of low prices of sale to the consuming public, thereby making such illuminated pool game economically available to the buying public.

Still yet another object of the present invention is to provide a new and improved illuminated pool game which provides in the apparatuses and methods of the prior art some of the advantages thereof, while simultaneously overcoming some of the disadvantages normally associated therewith.

Still another object of the present invention is to play pool in the absence of ambient light and improve the aesthetic appearance thereof.

Lastly, it is an object of the present invention to provide a new and improved illuminated pool game including balls each with a spherical shell and hollow spherical interior space. Also included is a plurality of optic fibers having an associated light located within the interior space of each ball. Each optic fiber includes a first end in communication with the interior space of the ball and a second end in communication with an outer surface of the ball for emitting light therefrom. Also included is a pool table comprising a multiplicity of light units each secured within an associated bore formed below a playing surface thereof. Such light units include both motion detection and timer circuitry for simulating an illuminated trail when a ball is rolled thereon. The table further includes a transparent peripheral bumper including a plurality of bulbs for the illumination thereof. A ball return cut out is formed on a side portion of the pool table. The ball return cut out comprises an optic fiber situated along a periphery thereof for illuminating the same. Finally, an elongated pool cue with a tip end and a handle end is included. The pool cue comprises an optic fiber longitudinally situated therein with an associated light for emitting light from the tip end of the cue via the optic fiber.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the illuminated pool game constructed in accordance with the principles of the present invention.

FIG. 2 is a cut away view of a pocket of the pool table.

FIG. 3 is a cross-sectional view of the bumper taken along line 3—3 shown in FIG. 2.

FIG. 4 is a cross-sectional view of the playing surface thus depicting the associated light units.

Similar reference characters refer to similar parts throughout the several views of the drawings.

DESCRIPTION OF THE PREFERRED EMBODIMENT

Figure 7:
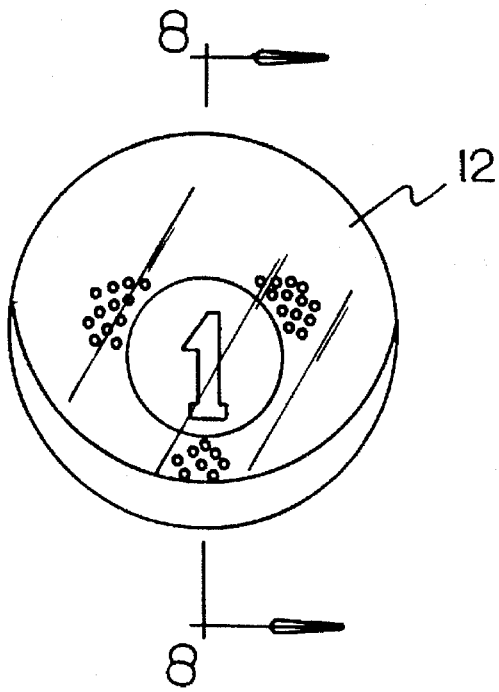
FIG. 7 is a front plan view of the ball.

With reference now to the drawings, and in particular to FIG. 1 thereof, a new and improved illuminated pool game embodying the principles and concepts of the present invention and generally designated by the reference numeral 10 will be described.

The present invention, the new and improved illuminated pool game, is comprised of a plurality of components. Such components in their broadest context include a plurality of balls, a pool table, and a pool cue. Such components are individually configured and correlated with respect to each other so as to attain the desired objective.

More specifically, it will be noted that the system 10 of the present invention includes a plurality of balls 12 each comprising a spherical shell 14 with a hollow spherical interior. The shell includes a first half 16 and a second half 18 both equivalently sized and screwably coupled. A plurality of optic fibers 20 are included with a first end in communication with an outer surface of the shell and a second end in communication with an inner surface of the shell. Thus, the fibers are adapted to emit light from the outer surface of the shell upon the application of light to the second end thereof. Each ball further comprises a tripod brace 22 having a first leg 24 coupled to the inner surface of the first half of the shell. A pair of remaining legs 26 are adapted to abut the inner surface of the second half when the halves are screwably fixed. A light emitting diode 27 is coupled to an apex of the brace. For powering purposes, a battery 28 is releasably connected to the light emitting diode and secured t the apex for allowing the light emitting diode to apply light to the second end of each optic fiber. As an option a switch may be included for selectively activating and deactivating the light emitting diode of each ball. Such a switch may be radio or sound controlled. For allowing the identification of each ball, color and indicia in the form of a numeral and optional stripes are printed thereon. Alternate printed designs may also be employed to improve the aesthetic appearance of the balls.

Also included is a pool table 30 comprising a flat playing surface 32. Such surface has a multiplicity of light units 34 each secured within an associated bore 36 formed below a top plane thereof. Each light unit includes a transparent lens 38 situated in a top portion of the associated bore and flush with the top plane of the playing surface. A light 40 is adjacently situated below the lens and adapted to emit light upon the activation thereof. A motion sensor 42 is adjacently situated below the lens for generating a detection signal upon the detection of motion directly above on the playing surface. Timer circuitry 44 is electrically connected to the light emitting diode, motion sensor, and a power bus situated beneath the playing surface. The timer circuitry activates the associated light for a predetermined amount of time upon the receipt of the detection signal. Preferably, the timer circuitry is engineered so that a moving ball creates an approximate 12 inch trail. Furthermore, the timer circuitry may be adapted to deactivate each light gradually thus affording a fading effect. A transparent layer covers the entire playing surface whereby when a ball is rolled thereon, the lights temporarily emit light thus simulating an illuminated trail. Ideally, the layer is constructed of an elastomeric material, but alternatively may be made of a transparent cloth. While the foregoing method is preferred, various methods of activating the lights such as by means of conduction or weight may be employed.

The pool table further includes a transparent peripheral bumper 46 including a plurality of bulbs 48. Such bulbs are fixed within associated compartments formed in the bumper. A plurality of optic fibers 50 are horizontally situated within the bumper adjacent to an inner edge thereof. Each optic fiber has an end 52 normally situated with respect to the remaining fiber and further positioned adjacent to the bulb for illuminating the entire bumper. A ball return cut out 54 is formed on a side portion of the pool table. The ball return cut out comprises an optic fiber 56 situated along a periphery thereof for illuminating the same.

It should be noted that the number of pockets, method of ball return, and size of the billiard table all correspond to that which is conventional in the art. Also, the weight of the balls may be altered to effect a proper frictional relationship depending on the type of transparent layer employed.

Figure 5:
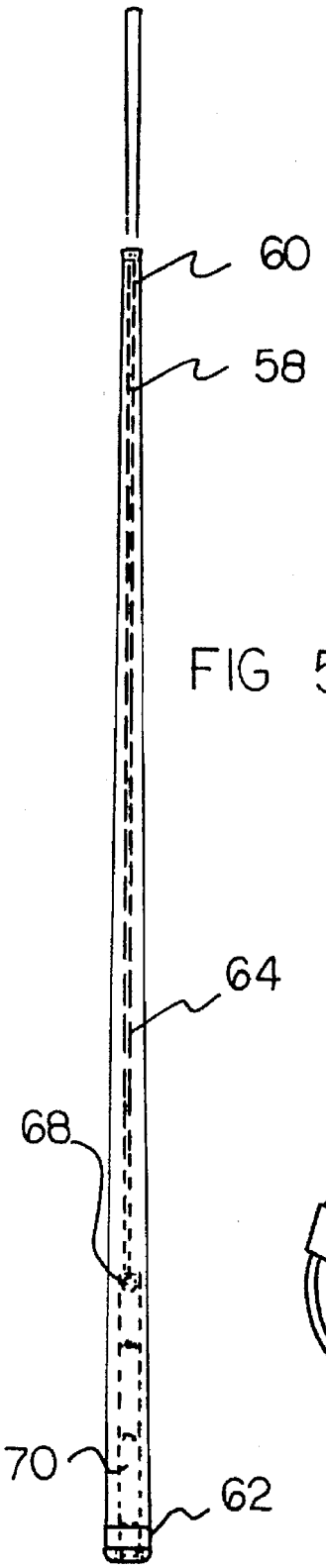
FIG. 5 is a plan view of the pool cue.
Figure 6:
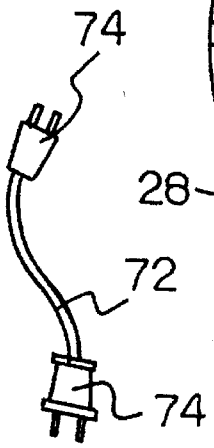
FIG. 6 is an elevational view of the charger cord.
Figure 8:
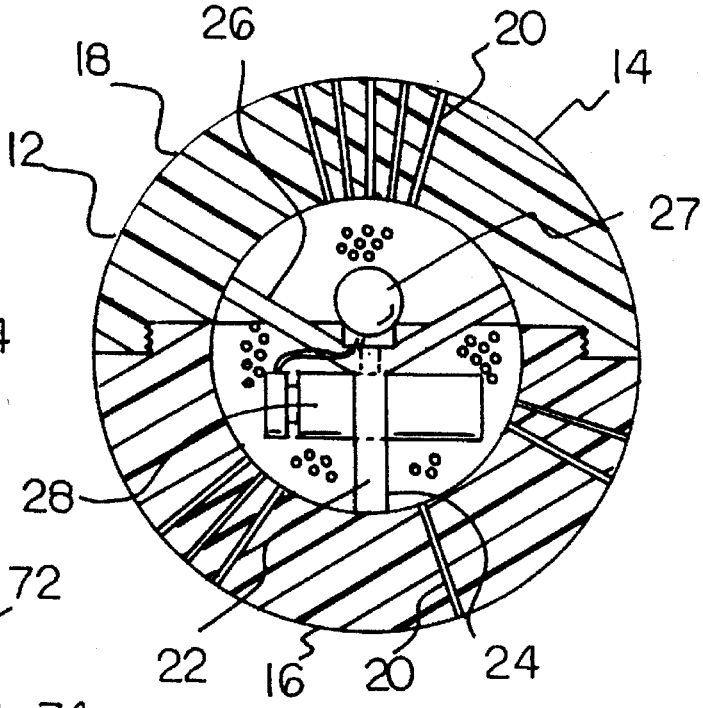
FIG. 8 is a cross-sectional view of the ball taken along line 8—8 shown in FIG. 7.

With reference now to FIG. 5, an elongated pool cue 58 with a tip end 60 and a handle end 62 is included. The pool cue comprises an optic fiber 64 longitudinally situated within an axial bore formed therein. The fiber has a first end situated adjacent to the tip end of the cue, a transparent tip 66 constructed of a resilient material secured to the tip end thereof, and a light 68 electrically connected to a plurality of batteries 70 situated within the handle end of the cue. Thus, the light is adapted to emit light from the tip end of the cue via the optic fiber. Optionally, as shown in FIG. 6, a charger cord 72 may be included with a pair of 3-prong ends 74. The charger is cord adapted to allow the recharging of the pool cue batteries.

It should be noted that the concepts utilized in the present invention may be employed in other various game and sport devices without departing from the scope of the present invention. Such game and sport devices include bowling balls and pins, soccer balls, basket balls and backboards, and volley balls and nets.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved illuminated pool game comprising, in combination:

a plurality of balls each comprising a spherical shell with a hollow spherical interior, the shell including a first half and a second half both equivalently sized and screwably coupled and a plurality of optic fibers each with a first end in communication with an outer surface of the shell and a second end in communication with an inner surface of the shell whereby the fibers are adapted to emit light from the outer surface of the shell upon the application of light to the second end thereof, each ball further comprising a tripod brace having a first leg coupled to the inner surface of the first half of the shell and a pair of remaining legs adapted to abut the inner surface of the second half when the halves are screwably fixed, a light emitting diode coupled to an apex of the brace, and a battery electrically coupled to the light emitting diode for allowing the light emitting diode to apply light to the second end of each optic fiber;

a pool table comprising a flat playing surface with a multiplicity of light units each secured within an associated bore formed below a top plane of the playing surface, each light unit including a transparent lens situated in a top portion of each bore and flush with the top plane of the playing surface, a light adjacently situated below the lens and adapted to emit light upon the activation thereof, a motion sensor also adjacently situated below the lens for generating a detection signal upon the detection of motion on the playing surface, and timer circuitry electrically connected to the light emitting diode, motion sensor, and a power bus situated beneath the playing surface for activating the associated light for a predetermined amount of time upon the receipt of the detection signal; a transparent layer covering the entire playing surface, whereby when a ball is rolled thereon, the lights temporarily emit light thus simulating an illuminated trail; a transparent peripheral bumper including a plurality of bulbs fixed therein and a plurality optic fibers horizontally situated therein adjacent to an inner edge thereof with each fiber having an end normally situated with respect to the remaining fiber and further positioned adjacent to the bulb such that the entire bumper is illuminated; and a ball return cut out formed on a side portion of the pool table comprising an optic fiber situated along a periphery thereof for illuminating the same; and an elongated pool cue with a tip end and a handle end comprising an optic fiber longitudinally situated within an axial bore formed therein, the fiber having a first end situated adjacent to the tip end of the cue, a transparent tip constructed of a resilient material secured to the tip end thereof, and a light electrically connected to a plurality of batteries situated within the handle end of the cue, whereby the light is adapted to emit light from the tip end of the cue via the optic fiber.

2. An illuminated game device comprising:

a playing ball means;

a power source comprising a battery;

a plurality of light emitting diodes situated within the ball means and electrically connected to the power source; and a multiplicity of optic fibers each situated within the playing-ball means with a first end positioned adjacent to the surface thereof and a second end positioned adjacent to one of the light emitting diodes, whereby the ball means emits fiber optic light for use in the absence of ambient light.

3. An illuminated game device as set forth in claim 2 wherein the ball means comprises a plurality of balls each having a spherical shell with a hollow spherical interior, the shell including a first half and a second half both equivalently sized and screwably coupled and a plurality of optic fibers each with a first end in communication with an outer surface of the shell and a second end in communication with an inner surface of the shell whereby the fibers are adapted to emit light from the outer surface thereof upon the application of light to the second end thereof, each ball further comprising a tripod brace having a first leg coupled to the inner surface of the first half of the shell and a pair of remaining legs adapted to abut the inner surface of the second half when the halves are screwably fixed, a light emitting diode coupled to an apex of the brace, and a battery electrically coupled to the light emitting diode for allowing the light emitting diode to apply light to the second end of each optic fiber.

4. An illuminated game device as set forth in claim 2 and further comprising a pool table including a flat playing surface with a multiplicity of light units each secured within an associated bore formed below a top plane of the playing surface each light unit including a transparent lens situated in a top portion of each bore and flush with the top plane of the playing surface, a light adjacently situated below the lens and adapted to emit light upon the activation thereof, a motion sensor also adjacently situated below the lens for generating a detection signal upon the detection of motion on the playing surface, and timer circuitry electrically connected to the light emitting diode, motion sensor, and a power bus situated beneath the playing surface for activating the associated light for a predetermined amount of time upon the receipt of the detection signal; a transparent layer covering the entire playing surface, whereby when a ball is rolled thereon, the lights temporarily emit light thus simulating an illuminated trail; a transparent peripheral bumper including a plurality of bulbs fixed therein and a plurality optic fibers horizontally situated therein adjacent to an inner edge thereof with each fiber having an end normally situated with respect to the remaining fiber and further positioned adjacent to the bulb such that the entire bumper is illuminated; and a ball return cut out formed on a side portion of the pool table comprising an optic fiber situated along a periphery thereof for illuminating the same.

5. An illuminated game device as set forth in claim 2 and further comprising an elongated pool cue with a tip end and a handle end comprising a optic fiber longitudinally situated within an axial bore formed therein with the fiber having a first end situated adjacent to the tip end of the cue, a transparent tip constructed of a resilient material secured to the tip end thereof, and a light electrically connected to a plurality of batteries situated within the handle end of the cue, whereby the light is adapted to emit light from the tip end of the cue via the optic fiber.

* * * * *